US006557267B2

(12) United States Patent
Wanger

(10) Patent No.: US 6,557,267 B2
(45) Date of Patent: May 6, 2003

(54) METHOD FOR THE HEAT TREATMENT OF BALES

(76) Inventor: Freddy Wanger, Riedmatttenstrasse 11, CH-5452 Oberrohrdorf (CH)

( * ) Notice: Subject to any disclaimer, the term of this patent is extended or adjusted under 35 U.S.C. 154(b) by 149 days.

(21) Appl. No.: 09/844,038

(22) Filed: Apr. 27, 2001

(65) Prior Publication Data

US 2001/0049884 A1 Dec. 13, 2001

Related U.S. Application Data

(60) Provisional application No. 60/200,804, filed on May 1, 2000.

(51) Int. Cl.[7] ..... F26B 5/04

(52) U.S. Cl. ..... 34/411; 34/348; 34/357; 34/380; 19/65 A; 19/66 R; 131/300; 131/302

(58) Field of Search ..... 34/348, 357, 380, 34/381, 403, 404, 409, 411, 418, 448, 452; 19/27, 48 R, 65 A, 66 R; 131/296, 300, 301, 302

(56) References Cited

U.S. PATENT DOCUMENTS

| | | | | |
|---|---|---|---|---|
| 3,802,030 A | * | 4/1974 | Acree | 19/66 CC |
| 3,931,825 A | * | 1/1976 | DeCoursey | 131/140 A |
| 4,008,724 A | * | 2/1977 | DeCoursey | 131/133 A |
| 4,999,926 A | | 3/1991 | Knabenhans et al. | |
| 5,121,522 A | | 6/1992 | Leifeld et al. | |
| 6,094,840 A | | 8/2000 | Wanger | |
| 6,237,195 B1 | * | 5/2001 | Shoemaker | 19/66 C |

FOREIGN PATENT DOCUMENTS

| | | |
|---|---|---|
| EP | 0 275 812 A1 | 7/1988 |
| EP | 0 375 629 A1 | 6/1990 |

* cited by examiner

*Primary Examiner*—Pamela Wilson
(74) *Attorney, Agent, or Firm*—Schweitzer Cornman Gross & Bondell LLP

(57) ABSTRACT

A heat treatment process for fiber feedstock, comprises repeatedly subjecting the bale to a reduced pressure atmosphere followed by the introduction of steam which permeates the bale. The interior of the bale may ultimately reach a temperature of about 80° C., which conditions and sanitizes the cotton fibers. Reduced pressure in the range of 20–200 mbar and steam treatment time in the order of 5 minutes can be employed.

9 Claims, 1 Drawing Sheet

Fig. 1a
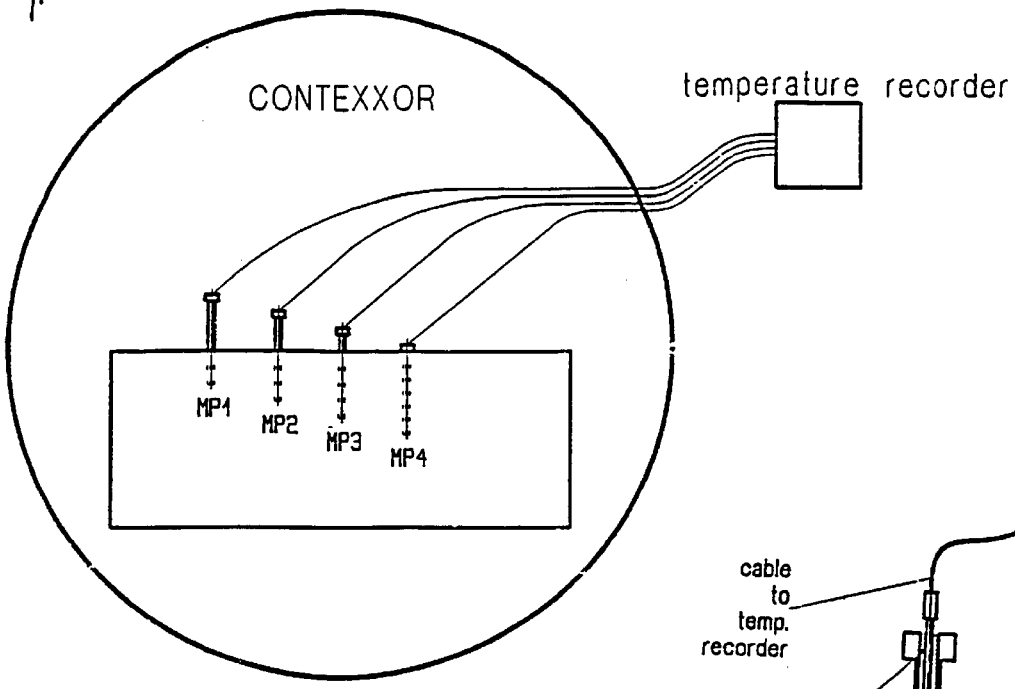
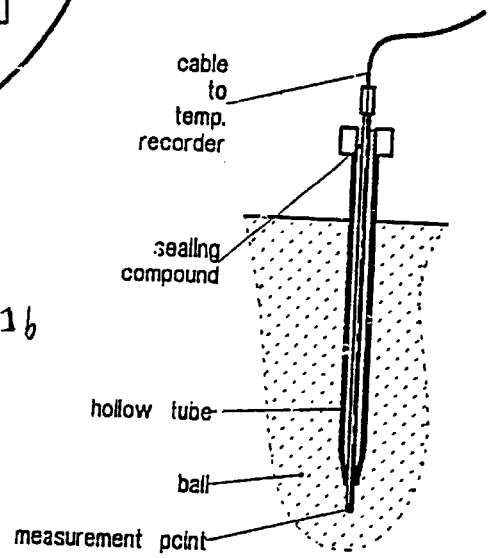
Fig. 1b
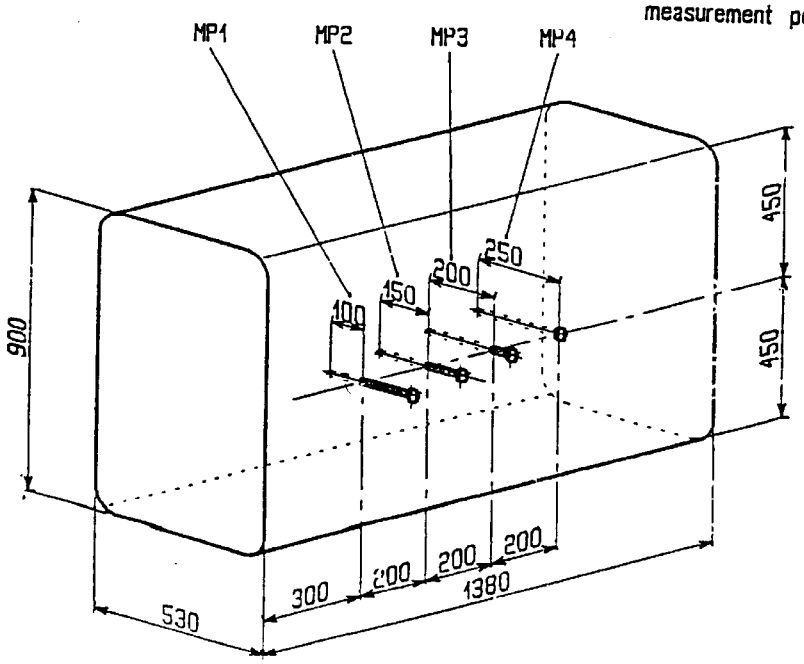
Fig. 1c

METHOD FOR THE HEAT TREATMENT OF BALES

This application claims the benefit of Ser. No. 60/200,804, filed May 1, 2000.

BACKGROUND OF THE INVENTION

During conventional fabrication of textile feedstock, especially of cotton pressed in bales, numerous health, technical and economic problems often arise.

These problems include the development of health threatening molds, especially aflatoxines in the leaves (bracts); insufficient moisture for subsequent treatment steps; and wild behavior of the delivered material in the processing machine or gin before subsequent treatment depending on the quality of the cotton gin, its previous storage condition, press condition and moisture content.

Attempts to pretreat the feedstock to address the problems have been unsuccessful for technical and/or economic reasons.

It is therefore a purpose of the present invention to provide a process to solve health and technical problems which have affected prior art textile feedstock fabrication processes.

It is a further purpose of the invention to provide a process which allows an improvement in the quality of the spun yarn, with a raised yield.

Yet a further purpose of the present invention is to provide a feedstock preparation method which is reproducible, efficient, and which produces a feedstock which is greatly restricted in its biological activity, especially insuring that only a minimal further development of mold fungi can occur, even in the case of a new contamination occurring by means of airborne spores.

BRIEF DESCRIPTION OF THE INVENTION

The foregoing and other objects of the invention are achieved by a heat treatment of the feedstock in a pressed state, i.e. in the bale. By a specific, gradual heat treatment of the bale at least partial sterilization and a conditioning of the feedstock is effected simultaneously.

The heat treatment of the present invention comprises placing the feedstock in a treatment chamber and subjecting the feedstock to a plurality of treatment cycles comprising the evacuation of the chamber to a reduced pressure, and the application of steam to the feedstock for a treatment period to allow the steam to penetrate into the interior of the bale. At least 4, and preferably 5 treatment cycles are conducted.

The heat treatment can be accomplished by a type of fractional conditioning (alternating evacuation and steaming with holding times) which may be carried out by conventional treating systems as marketed by Xorella AG, CH-5430 Wettingen, Switzerland under the trademark SYSTEM CONTEXOR.

It has been surprisingly found that the present invention makes it possible to successfully treat a heavily pressed cotton bale in an economically reasonable time with an economically justifiable expenditure of energy. The treatment installation is preferably operated according to WO 98/21390 and U.S. Pat. No. 6,094,840.

It has been found that a 5 cycle steaming procedure yields an ultimate temperature of about 80° C. in the inner part of the bale. Higher bale temperatures may be desired or utilized when required for sterilization or destruction of biologically active material.

BRIEF DESCRIPTION OF THE DRAWINGS

A fuller understanding of the invention will be achieved upon consideration of the following description of the invention when considered in connection with the annexed drawings, in which:

FIGS. 1*a–c* are diagrams depicting the structure and placement of temperature probes in a cotton bale for test purposes.

DETAILED DESCRIPTION OF THE INVENTION

It is known in the art that the conditioning of textile feedstocks, and particularly by conditioning by steam treatments, improve the process ability and quality of the resulting fabric. Conditioned knitting yarns exhibit reduced unwinding tension and are of a softer quality than untreated yarn, reducing needle wear. Further, consistency of the finished products is improved with a substantial decrease in lint and fiber fly. Weaving processes utilizing yarns which have been subject to such conditioning have fewer breaks, improved strength and elongation qualities, and yield softer fabrics. Similarly, treated fabrics experience increased sewing efficiency with fewer needles breaks and improved needle wear. While conventional conditioning treatments are applied to the yarns and threads, the present invention provides an improved methodology for such general heat treatment, and is of particular benefit in connection with cotton, which in accordance with the invention may be treated in the bale, rather than in the form of yarn or finished fabric, thus increasing treatment efficiency. By applying a repeated procedure of evacuation and steam application treatment through the entirety of the bale can be effected in an economical manner.

In general, the present procedure comprises placing the cotton bale to be treated in a closed container, and evacuating the container to a reduced pressure in the range of about 50 to 200 mbar. Steam is then introduced, and the steam is allowed to permeate the bale for a treatment period typically between 5 and 15 minutes, during which steaming step the internal temperature of the bale increases to roughly between 600 and 80° C. The container is again evacuated, the remaining steam being simultaneously withdrawn and condensed exterior to the container, and the procedure is repeated. Preferably, the fabric is subjected to a minimum of 4 steaming cycles. The the end of the treatment the cotton bale is removed. After an appropriate cool-down period, during which time a small amount of residual moisture evaporates, the bale can be wrapped for shipment.

Each steam treatment step may be of a chosen duration, on the order of 5 minutes, which typically allows the interior of the bale to reach between 60° and 80° C., the bale temperature increasing with each steaming cycle. A final interior temperature of 80° C. is preferred to insure extermination or elimination of bacteria and/or mold. Temperature monitoring of the bale may be conducted using temperature sensor probes, with the treatment step time being dictated by the interior bale temperature desired. Similarly, the vacuum employed may be at levels of between about 50 and 200 mbar, with the greatest vacuum typically being applied in the initial treatment step. Vacuums of 50, 200, 2000 and 200 mbar for a five cycle process may be acceptable, the vacuum serving primarily to facilitate the entry of the steam deep into the bale and thus improving heat transfer between the steam and bale. Overall process time, including treatment steps and the time necessary to re-evacuate the chamber between treatment steps, is in the order of less than 2 hours.

The procedure may be carried out in a vacuum steamer chamber of the type known in the art having an internally located water bath which is heated to generate the steam. Alternatively, the steam can be generated exterior to the chamber and introduced to the evacuated chamber through appropriate valved piping. Vacuum pumps and condensers as known in the art establish the vacuum and exhaust the remaining water vapor/steam at the end of a steaming cycle. When an external steam source is used, as opposed to a heated water bath, it may be advantageous to have a drain to allow condensate to be withdrawn before or during vacuum establishment.

The following sets forth a series of tests carried out in accordance with the invention and are exemplary of the parameters which may be employed in connection therewith.

A bale having the dimensions 1380×530×900 mm, a volume V=660 $cm^3$, weight G approx. 250 kg and a density y=0.38 $kg/dm^3$ was subjected to a treatment in accordance with the present invention. Temperature probes were inserted at different locations within the bale as depicted in FIGS. 1*a*–1*c*. A Xorella CONTEXXOR treatment unit with a volume of 10.2 $m^3$ was utilized for the treatment process.

The bale was subjected to a steaming/evacuation program with four vacuum cycles, as follows:

Steaming Program

1st vacuum: 050mbar=95%

1st cycle: T1=600° C.—5 min.

Start 1st cycle with empty evaporator, or with cold water bath.

2nd vacuum: 100mbar=90%

$2^{nd}$ cycle: T2=70° C.—5 min.

3rd vacuum: 100 mbar=90%

$3^{rd}$ cycle: T3=80° C.—10 min.

4th vacuum: 200 mbar =80%

$4^{th}$ cycle: T4=80° C.—15 min.

Total time: approx. 100 minutes

Weight Increase of Bale with 4 Measuring Probes and Pallet

Before conditioning: 258.60 kg=100% weight 05 minutes after conditioning: 268.90 kg=+3.98% weight increase.

90 minutes after conditioning: 267.40 kg=+3.40% weight increase.

Weight of measuring probes 1.25 kg.

Weight of pallet: 14.35 kg.

After a cooling time of 90 minutes, the measuring probes were removed and the bale was wrapped in foil with a pallet binder. In practice it takes about 1–1½ hours before the bales can be packed. A weight increase of 3.0% to a maximum of about 3.2% can therefore be expected.

Notes on Test Procedure

The test was erroneously carried out in 2 phases, because on startup and after the first cycle the CPU failed due to software intervention with the programming unit. After the first cycle (96%, 60° C.—5 min.) and after reaching the first intermediate vacuum, the program stopped when the heating was switched on, and the evaporator was vented. The process was then restarted. The process was restarted after correcting the above-mentioned fault. And the program ran according to the preselected process steps. In general, phase 1 had no effect on the test parameters. This test can be evaluated as a normal steam program with 4 cycles with a prior warm-up program Vacuum The startup vacuum of 50 mbar=95% of the vacuum was generated with a gas jet at the vacuum pump intake. The gas jet was not switched on until vacuum had reached 90%.

The intermediate vacuum up to 100 mbar was generated with a tube bank condenser at the vacuum pump intake.

Measuring point MP1 reached the setpoint temperature T1=60° C. after the first cycle, and followed the pre-selected temperatures in the subsequent cycles. Steam penetration to a depth of 100 mm occurred by the end of the first cycle.

Temperatures at depths of 150 and 200 mm respectively for MP 2 and MP 3 started to rise significantly during the warm-up phase of the second vacuum cycle to the setpoint temperature T2=70° C., although the setpoint temperatures was not yet reached. The MP2 setpoint temperature T=80° C. at the 150 mm depth was not reached until the holding phase of the third vacuum cycle.

The MP 3 setpoint temperature T=80° C. at the 200 mm depth was reached during the fourth vacuum cycle. By this time steam had penetrated the bale to a depth of about 200 mm.

The temperature rise at MP 4 inside the bale was slow. The temperature rose at 0.75° C. per minute on average. However, the temperature rise was steeper after the end of each vacuum cycle, indicating that steam penetration is accelerated by the intermediate The setpoint temperature at measuring point MP 4 was reached 10 minutes after reaching the fourth cycle temperature.

Steam penetration is theoretically complete after reaching the setpoint temperature T4=80° C. side the bale. Further steaming time does not increase humidity since the entire bale is then heated up to a temperature of 80° C.

Weight Loss After Packaging

After a cooling time of 90 minutes, the measuring probes were removed and the bale was wrapped in foil with a pallet binder for storage. The temperature inside the bale was still high at this time, as shown by the following readings:

Measuring point MP 1: 70° C.

Measuring point MP 2: 76° C.

Measuring points MP 3,4: 78° C.

Weight loss of packaged bale No. 1 including pallet

| Days | Weight w/pallet | Difference |
|---|---|---|
| Start | 267.45 kg | (100%) |
| 2 | 267.30 kg | 0.15 kg = 0.00% |
| 4 | 267.15 kg | 0.30 kg = 0.11% |
| 8 | 266.90 kg | 0.55 kg = 0.20% |
| 13 | 266.65 kg | 0.80 kg = 0.30% |
| 21 | 266.65 kg | 0.80 kg = 0.30% |
| 26 | 266.70 kg | 0.75 kg = 0.30% |

Weight loss of the packaged bale after 2 weeks of storage was 0.3% referred to the original weight of 267.45 kg. No weight change occurred during the following week.

Assuming that the wrapping foil is impermeable to air, no further weight losses are expected. The above-mentioned weight loss of 0.80 kg also includes that of the timber pallet weighing about 15 kg. Steaming increased the pallet weight by about 4% due to 0.60 kg additional water content, which evaporates during storage.

If this pallet weight loss: of about 0.60 kg is deducted from the total weight loss, weight loss attributable to the foil is practically negligible at only 0.20 kg or 0.075%.

Condensate Accumulation

After 2 hours of cooling time a condensate film is formed inside the packaging foil, which about 2 days later had consolidated into water drops. These water drops were still clearly visible two days later, but they were no longer visible when the weight measurement was taken 8 days after packaging.

The cotton bales cooled down within about 4 days, when evaporation ceased and the cotton bales reabsorbed the condensate drops. Cotton can absorb up to about 15% of its own weight in moisture at 100% air humidity.

Steam penetration can be accelerated by increasing the temperature as rapidly as possible to the setpoint value of about 80° C. after reaching 100 mbar vacuum. Since steam has a vapor saturation pressure of about 450 mbar at 80° C., the pressure differential is then 450−100=350 mbar; this helps to force steam into the bale more efficiently and rapidly.

Theoretical Considerations

The weight increase after steaming was 3.98%. This fact alone establishes that 100% of the bale mass was heated up by steaming.

The theoretical weight increase is calculated as follows based on the given data:

Net weight of bale: G=250.00 kg

Specific heat of cotton: c=1.3 kJ/kg° C.

Temperature differential: $\alpha T=80°-20°=60°$ C.

Vaporization heat of steam: r=2350 kJ/kg steam

Thermal energy Q required for cotton bale heating to 80° C.:

$$Q=c\times G\times \Delta T$$

$$Q=1.3\times 250\times 60=19{,}500 \text{ kJ}$$

The bale is heated with saturated steam The steam transfers its vaporization heat to the cotton through condensation. Cotton is hygroscopic and can store up to 18% by weight of moisture at 20° C. Since the cotton absorbs the condensate, its weight increases according to the amount of steam required.

With an evaporation heat of r=2309 kJ per kg steam, the following steam quantity D is required:

$$D=Q/r$$

$$D=19{,}500/2350=8.29 \text{ kg steam}$$

8.29 kg of steam is therefore required to heat the cotton bale to 80° C. The steam then condenses into 8.29 kg of water, which is absorbed by the cotton. This weight increase of 8.29 kg corresponds to a 3.32% increase.

Since the above calculation does not take into account the original moisture content of about 6%, the actual weight increase is about 13% more than calculated, i.e. about 3.75%. The difference between this figure and the measured weight increase of 3.93%—which is greater than theoretically calculated—is attributable to weighing precision of the balance of +/−0.2 kg and of the physical data.

In a second test in accordance with the invention, a 5-cycle procedure was performed on a bale under the following conditions:

Steaming Program $1^{st}$ vacuum: 50 mbar=95%

1st cycle: T1=80° C.—2 min.

Start 1 st cycle with empty evaporator, or with cold waterbath.

$2^{nd}$ vacuum: 200 mbar=80%

$2^{nd}$ cycle: T2=80° C.—5 min.

$3^{rd}$ vacuum: 200 mbar=80%

$3^{rd}$ cycle: T3=80° C.—5 min.

$4^{th}$ vacuum: 200 mbar=80%

$4^{th}$ cycle: T4=80° C.—7 min.

$5^{th}$ vacuum: 200mbar=80%

$5^{th}$ cycle: T5=80° C.—9 min.

Total time: approx. 100 minutes.

Weight Increase of Bale Measuring Probes and with Pallet

Before conditioning: 260.80 kg=100% weight minutes after conditioning: 270.15 kg=3.58% weight increase.

After about 10 minutes the bale, probes and pallet were wrapped in foil.

Cooling of the wrapped bale

The cooling temperature readings were as follows:

After 1 day:

MP 2, 3, 4 interior 50° C.

MP 1 exterior 45° C.

After 2 days:

MP 2, 3, 4 interior 35° C.

MP 1 exterior 32° C.

Notes on Test Procedure

Control System

On OP 5 a 1-cycle program was programmed with T=80° C. for 99 minutes. During the holding time of 99 minutes the vacuum pump was switched on and off manually. The holding time for each cycle was maintained until it was clearly established that the temperatures at measuring points 1 to 4 either changed or remained unchanged.

Vacuum

Startup Vacuum—50 mbar

The startup vacuum of 50 mbar=95% was generated with a gas jet at the vacuum pump intake. The gas jet was not switched on until vacuum had reached 90%. The time required to reach the correct vacuum with cold water bath was rather long at 15 minutes. According to calculation ($t=60\times V/S\times \ln p1/p2=60\times 10{,}2/400\times 3=5$), the vacuum should be attained within about 5 minutes. With a cooling water temperature of 15° C. and dry air extraction, vacuum pump operating conditions were optimal. The long time required may be attributable to evaporator leakage or to vacuum pump power deficiency. Intermediate Vacuum—200 mbar The intermediate vacuum up to 200 mbar was generated with a tube bank condenser at the vacuum pump intake. The first 2 vacuums after the 1 st and 2nd cycles lasted 7 minutes, and 8–9 minutes after the 3rd and 4th cycles. The reason for this longer vacuum time after cycles 3 and 4 was that part of the bale mass had already been heated up after the 3rd cycle and had to be cooled down again during the vacuum phase.

Measuring Point Temperature Sequence

Temperatures at the 4 measuring points were recorded during the process.

Measuring Point MP 1: Depth 100 mm (Black)

The temperature at this point did not begin to rise until the $2^{nd}$ cycle heating and holding phase. It reached the setpoint value at the beginning of the $3^{rd}$ cycle.

Measuring Point MP 2: Depth 150 mm (Green)

The temperature at this point did not begin to rise until the 3rd cycle heating and holding phase. It then rose in parallel with the steam temperature, but only reached the setpoint temperature at the beginning of the $5^{th}$ cycle heating phase. During the $4^{th}$ cycle holding phase the temperature no longer rose and remained constant. Extending the holding time would therefore have been pointless since the temperature would not have increased any Measuring Point MP 3: Depth 200 mm (Blue)

This temperature characteristic was similar to that at MP 2, but at rather lower temperature level. The setpoint temperature was reached together with MP 2 at the beginning of the $_5{}^{th}$ cycle heating phase.

The temperature characteristics at MP 2 and MP3 clearly show that 4 cycles are not enough: the fifth cycle is essential. The $4^{th}$ cycle holding time can however be shortened from 7 to 5 or even 3 minutes.

Measuring Point MP 4: Depth 250 mm (Brown)

As in test No. 1, the temperature at MP 4 inside the bale rose only slowly at approx. 0.75° C. per minute. The setpoint temperature was not reached until during the $5^{th}$ cycle holding time. Here again, the temperature rise was steeper after the end of each cycle.

Weight Loss After Packaging

After a short cooling time of only 10 minutes the bale was wrapped with the four probes inserted in order to record the temperature characteristics on cool down See comments on "Bale weight increase".

The total weight of the wrapped bale including probes and pallet on the steaming day was 271.35 kg The probes (weight 1.25 kg) were removed after temperature measurements 6 days later. The starting weight (100% reference for weight loss measurements) was: 271.35 kg−1.25 kg=270.10 kg Weight loss of packaged bale No. 3 including pallet

| Day | Weight with pallet | Difference |
|---|---|---|
| Start | 270.10 kg | None (100%) |
| 6 | 269.15 kg | 0.95 kg = 0.35% |
| 12 | 269.10 kg | 1.00 kg = 0.37% |

The percentage weight loss of 0.37% after 12 days was 0.07% more, or 20% higher than in test No. 1. So even after 12 days, the percentage weight loss was still about 0.3%. This large difference may be attributable to a lower quality packaging with stretch-foil, or to weighing inaccuracy. It can also be due to higher vapor diffusion through the foil with excessively warm packing in the case of bale No. 3.

If the 0.60 kg pallet weight is deducted as with test No. 1, the weight loss after 12 days is 0.40 kg or 0.15%.

Condensation Inside the Packaging Foil

Condensate formed inside the foil and was re-absorbed by the cotton fibers within 5 to 6 days.

In order to reach steaming temperature as quickly as possible, direct steam injection is preferred. At T=80° C. the vapor pressure is about 500 mbar, so that steam is forced into the bale by a pressure differential of 300 mbar over the previous 200 mbar vacuum.

Direct steam injection can eliminate the problem of water batch contamination by cotton fibers.

At least four cycles are required. With adequate heating capacity, it should be possible to complete the process in no more than 2 hours.

Energy Consumption per Tonne of Cotton Fiber—Approx. 45 kWh

The theoretical energy consumption per tonne of yam with temperature rise A T=60° C. is 1.3×1000×60=78,000 kJ=22kWh. Taking into account the 4 to 5 reheating-required after the intermediate cycles, each time by about 20° C., as well as other losses, about 100% additional energy is required. In general we should expect here an optimistic energy consumption of about 45 kWh per tonne of yarn.

I claim:

1. A process for the heat treatment of bale fiber feedstock, comprising the steps of:

i. placing the bale in a sealed chamber;

ii. evacuating the chamber to a reduced pressure;

iii. introducing steam into the sealed chamber to raise the temperature of the bale to an elevated level;

iv. repeating steps ii and iii to effect a desired degree of conditioning of the bale; and v. removing the bale from the chamber.

2. The process of claim 1, wherein step iv is performed at least 3 times.

3. The process of claim 1, wherein step iv is performed 4 times.

4. The process of claim 2 wherein the temperature of the bale during the last repetition of step iii is 80° C.

5. The process of claim 2 wherein step iv is performed three times and the reduced pressure in the evacuating steps is 50, 100, 100 and 200 mbar.

6. The process of claim 3 in which the reduced pressure in the five evacuating steps is 50, 200, 200, 200 and 200 mbar, respectively.

7. The process of claim 3, wherein the temperature of the bale to be obtained during step iii is 60° C., 70° C., 80° C., and 80° C., respectively.

8. The process of claim 5 in which each step iii is maintained for about 5 minutes.

9. The process of claim 5 in which step iii is maintained for a period of 5 minutes, 5 minutes, 10 minutes and 15 minutes, respectively.

* * * * *